United States Patent [19]

Möe

[11] 4,062,445

[45] Dec. 13, 1977

[54] MEDICINE DISPENSERS

[76] Inventor: Kjell Möe, Stockbyvagen 3A, Stocksund, Sweden

[21] Appl. No.: 722,877

[22] Filed: Sept. 14, 1976

[51] Int. Cl.[2] ..... B65D 43/20; B65D 85/56

[52] U.S. Cl. ..... 206/1.5; 116/121; 220/346; 312/209

[58] Field of Search ..... 116/121, 135; 206/538, 206/535, 540, 528, 1.5; 220/346; 292/DIG. 38; 312/209

[56] References Cited

U.S. PATENT DOCUMENTS

| | | | |
|---|---|---|---|
| 3,537,422 | 11/1970 | Moe | 312/209 X |
| 3,618,559 | 11/1971 | Moe | 116/121 |
| 3,651,979 | 3/1972 | Severson | 220/346 |
| 3,812,963 | 5/1974 | Zahuranec et al. | 220/346 X |
| 3,888,350 | 6/1975 | Horvath | 206/540 X |
| 3,942,630 | 3/1976 | Phillips | 206/1.5 |
| 3,949,899 | 4/1976 | Jacobs | 220/346 |

FOREIGN PATENT DOCUMENTS

| | | | |
|---|---|---|---|
| 2,029,081 | 12/1970 | Germany | 292/DIG. 38 |

*Primary Examiner*—Daniel M. Yasich
*Attorney, Agent, or Firm*—William E. Mouzavires

[57] ABSTRACT

In a portable dispenser for medicines such as pills, tablets, capsules, etc., and which includes a case housing a plurality of separate medicine receptacles or compartments corresponding to certain periods in each day in the course of a week, and which has a plurality of transparent cover strips or slats which may be moved to open or close the receptacles to provide access to or close the receptacles; the improvement which includes a lock mechanism for normally locking the cover strips in closed position relative to one or more medicine compartment but which may easily be operated to release the cover strips to allow them to be moved to open position to provide access to the medicine compartments. The lock mechanism also permits the cover strips once open to be easily returned to closed position to close the underlying medicine compartments. The lock mechanism thus provides a positive element of safety to the dispenser which is particularly suitable in preventing accidental access to the pill compartments by infants or children.

11 Claims, 7 Drawing Figures

FIG. 1
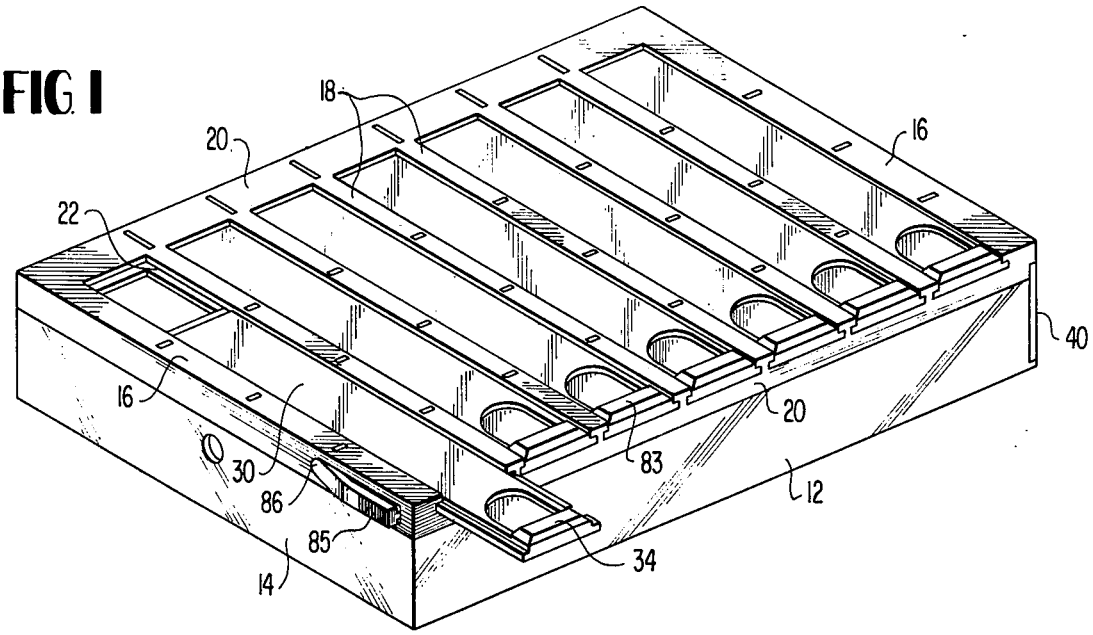
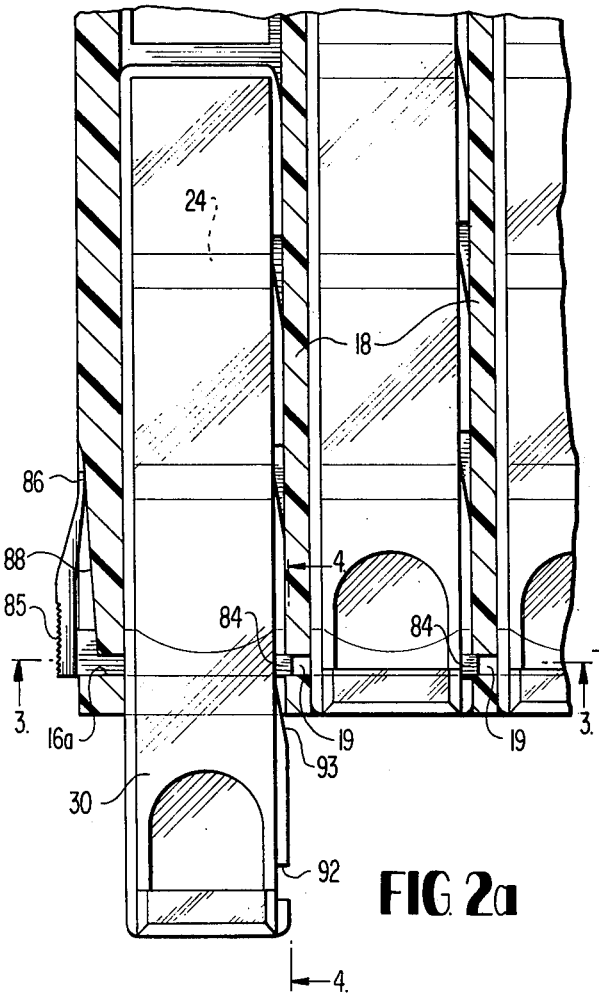
FIG. 2a
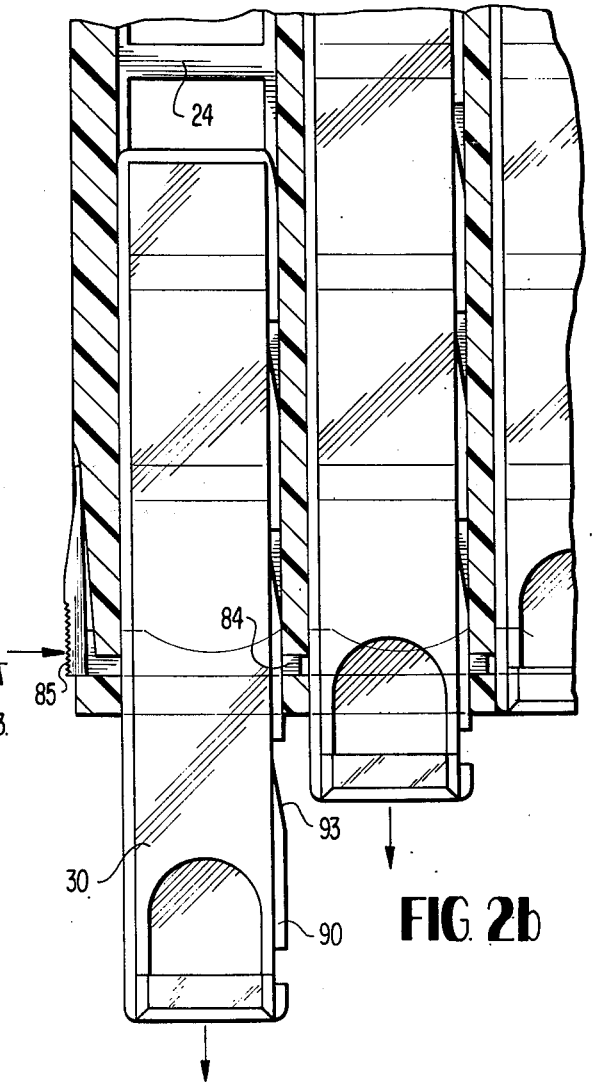
FIG. 2b

FIG. 3
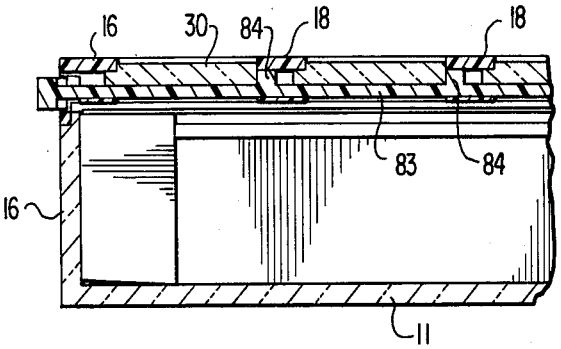
FIG. 4
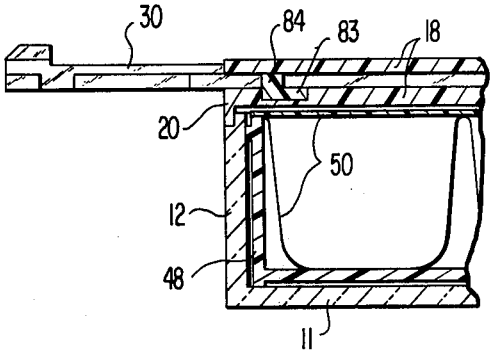
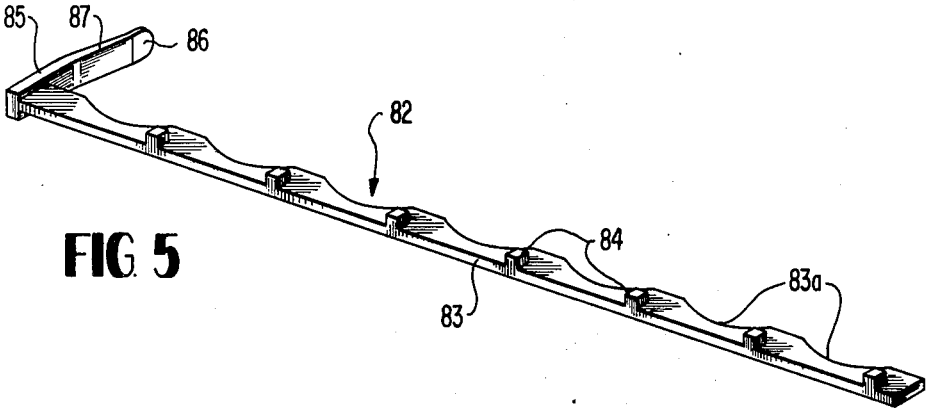
FIG. 5
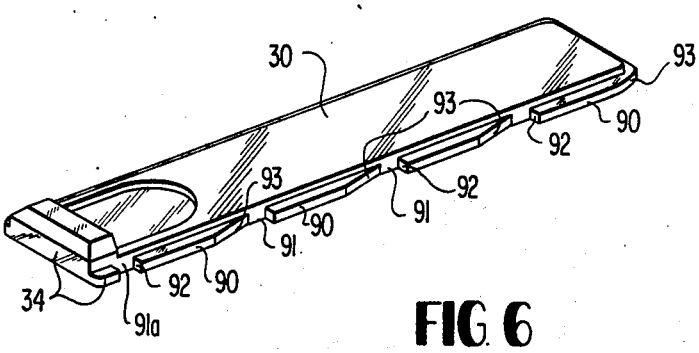
FIG. 6

MEDICINE DISPENSERS

RELATES PATENTS AND PATENT APPLICATIONS

The improvements of the present invention are particularly suitable for application to medical dispensers of the type disclosed in my U.S. Pat. No. 3,537,422, issued Nov. 3, 1970 and U.S. Pat. No. 3,618,559, issued Nov. 9, 1971, the latter being a division of the former, and my currently pending U.S. patent application Ser. No. 680,176, filed Apr. 26, 1976, entitled "Medicine Dispenser And Method". As will be apparent below, the improvement of the present invention is described in this application, for illustrative purposes, in connection with a particular embodiment of a medicine dispenser which is disclosed in my pending U.S. application Ser. No. 680,176, identified above. However, it will be understood that the improvements of the present invention may be applied to other medicine dispensers of the same general character.

BACKGROUND OF INVENTION

It has been established that the programmed storage and dispensing of medicines or drugs through the use of a small portable dispenser such as disclosed in my U.S. patents identified above, as well as my copending U.S. patent application identified above, can significantly increase the chances that the medicines will be effective for the intended purpose. Since such dispensers are intended for home or personal use, it has now become desirable to safeguard them against access to the medicine compartments by infants or children. Indeed, it is understood that in some countries laws or regulations have been promulgated requiring medicine dispensers to contain some sort of mechanism for either preventing unauthorized access to the medicines by children or for at least providing an impediment to the easy, simple opening of the medicine dispenser by children. Therefore, the present invention in one aspect is addressed to the aforementioned problem in the context of medicine dispensers of the type disclosed in my aforementioned patents and pending patent application but it will be apparent as the description proceeds that the invention will have applicability to other forms of medicine dispensers of the same general character.

SUMMARY OF INVENTION

The present invention generally relates to portable, small, medicine dispensers for home or personal use of the type disclosed, for example, in my aforementioned United States patents and pending patent applications. More specifically, the present invention relates to an improvement in such dispensers constituting a lock mechanism for rendering the medicine contents of the dispenser safe against unauthorized access by infants or children.

It is an object of the present invention to provide a small portable medical dispenser for home or personal use and which will permit programmed storage and dispensing of medicines over a period of time, for example, a week and yet at the same time will be safe against unauthorized access to the medicines by infants or children. Included herein is the provision of such a medicine dispenser which incorporates, in a unique manner, a lock mechanism which may be easily grasped by a finger to release the lock mechanism to permit opening of cover strips closing the medicine compartments when the user desires to take medicine. Further included herein is such a lock mechanism that permits the cover strips of the dispenser to be easily returned to closed position after the medicine has been removed from the compartment or after the compartments have been charged with a new supply of medicine.

Another object of the present invention is to provide, for medicine dispensers of the general character described in my aforementioned U.S. patents and pending patent applications, a novel lock mechanism which normally locks the cover strips overlying the medicine compartments but which may be easily operated by the finger to release the cover strips to permit them to open the compartments to provide access to the medicine by the owner of the dispenser.

DRAWINGS

Other objects and advantages of the present invention will become apparent from the following more detailed description taken in conjunction with the attached drawings in which:

FIG. 1 is a perspective view of a medicine dispenser incorporating the improvement of the present invention and shown with one of its cover strips in partially open position providing access to one of the medicine compartments;

FIG. 2*a* is an enlarged fragmental plan view of the left-hand side of the medicine dispenser shown in FIG. 1 and showing the lock mechanism in locking position preventing movement of the cover strips;

FIG. 2*b* is a view similar to FIG. 2*a* but with the lock mechanism shown in unlocked position allowing movement of the cover strips;

FIG. 3 is a fragmental cross-sectional view taken generally along lines 3—3 of FIG. 2*a;*

FIG. 4 is a fragmental cross-sectional view taken generally along lines 4—4 of FIG. 2*a;*

FIG. 5 is a perspective view of a lock member included in the lock mechanism of the present invention; and FIG. 6 is a perspective view of one of the cover strips containing locking ears included in the lock mechanism of the present invention.

DETAILED DESCRIPTION

Referring now to the drawings in detail and initially to FIG. 1, there is shown for illustrative purposes only a medicine dispenser of the type disclosed in my copending U.S. application Ser. No. 680,176 whose disclosure is hereby incorporated by reference into this application as part hereof. The dispenser disclosed in FIG. 1 embodies the improvements of the present invention. The structure includes a case having a base 11 (not shown in FIG. 1 but shown in FIGS. 3 and 4) which is rectangular in the shown embodiment, and opposite side walls 12 and one end wall 14 upstanding from the base with the opposite end of the case being open for receiving a tray 40; only the end of the tray being shown in FIG. 1. Fixed on the side walls 12 and end wall 14 is a top including opposite end pieces 16 joined by side pieces 20 defining a rectangular configuration. Extending between side pieces 20 and parallel to end pieces 16, are a plurality of ribs 18 having a generally T-shaped cross section defining recesses 22 for slidably receiving and guiding transparent cover slats or strips 30 which function to close or open medicine compartments in the tray 40 which is received in the case. Extending transversely of ribs 18 throughout the top of the case are a plurality of support ribs 24 for supporting transparent cover strips 30 for sliding movement in recesses 22 and also for defining the mouths of the medicine compartments.

It will thus be seen that the top of the case forms a rectangular grid pattern defining a plurality of rows of apertures which, in the preferred embodiment, are seven rows corresponding to seven days in a week with four apertures in each row corresponding to four times a day for the taking of medicines from the dispenser. Further, in the preferred embodiment, seven cover strips 30 corresponding to the seven days of the week and the seven rows in the top of the case are utilized.

In order to open one or more of the compartments in the case, the cover strip 30 overlying the compartment is slid along recesses 22 in ribs 18 of the case top. This is easily accomplished by grasping flanged ends 34 of the cover strips. FIG. 1 shows one of the cover strips 30 having been moved to open one of the medicine compartments. The cover strips are made from self-supporting transparent material preferably a suitable plastic, so that the contents of the medicine compartments are visible through the cover strips when the cover strips are closed.

The medicine compartments containing the pills, tablets, etc., are provided in the cae in any suitable manner; but in the preferred embodiment, the compartments are provided in a tray insert 50 (see FIG. 4) which is receivable in tray 40 which, in turn, is received in the case through the open end of the case opposite the end 14 as described above. Further details of the tray insert, the tray, and the case may be obtained by reference to my co-pending U.S. application identified above and which is incorporated by reference in this application. It should be understood, however, that the medicine compartments may be formed by other structures such as, for example, disclosed in my prior U.S. patents identified above.

In accordance with the present invention, a lock mechanism is provided for positively locking each of the cover strips 30 against movement along recesses 22 in the direction opening the medicine compartments. In the preferred embodiment shown, the lock mechanism includes an elongated lock member generally designated 82, including an elongated lock strip 83 which may be formed from any suitable self-supporting material such as plastic. Locking strip 83 is mounted for slidable movement in the top of the case through apertures 19 formed in ribs 18 adjacent the side piece 20 on the side of the case towards which the strips move when opening or uncovering the medicine compartments. Locking strip 83 extends parallel to top side piece 20 and extends throughout the full length of the top side piece 20 and through end pieces 16. The left end of locking strip 83, as viewed in the drawings, also extends through an aperture **16*a* formed in end piece 16 of the top piece of the case; the aperture 16*a* being identified in FIG. 2*a***.

As best shown in FIG. 5, actuating means in the form of a spring member is fixed to the left end of locking strip 83 and also at portion 86 is fixed to end piece 16 of the case top, the latter being shown in FIG. **2*a*. The actuating member includes a first portion 85 which, in the preferred embodiment, may be formed integral with locking strip 83 and extending approximately perpendicular therefrom, the anchoring portion 86 which, as noted above, is suitably fixed to top piece 16 of the case in a recess thereof, and an intermediate section 87 which interconnects portions 85 and 86 and extends at an angle to these portions which are offset from each other. The locking member may be formed as an integral plastic piece of resilient material. In view of the fact that portion 85 of the actuating member is offset from anchor portion 86, portion 85 may be moved to the right as indicated by the arrow in FIG. 2b to slide locking strip 83 to the right through apertures 19 in the ribs 18. This movement will function to release the cover strips 30** for movement to cover or uncover the medicine compartments as will be further described.

As best shown in FIG. 5, a plurality of stops 84 are fixed along locking strip 83 in serially spaced fashion corresponding to generally the width of the rows of the medicine compartments. When the actuating member 85 is in normal relaxed position, that is, released, stops 84 will be positioned in the path of movement of the cover strips 30 as illustrated in FIG. 2a thereby locking them against opening movement as will be further described. However, when the locking member 85 is depressed causing locking strip 83 to move to the right as viewed in the drawings, stops 84 will move into apertures 19 of the ribs 18 out of the path of cover strips 30 and permitting movement of the cover strips.

To lock cover strips 30 in position against movement, each of the cover strips is provided in the preferred embodiment along one side edge thereof with a plurality of locking ears 90, there being four ears in the disclosed embodiment corresponding to the four medicine compartments in each of the rows as shown in FIG. 6. Locking ears 90 on each of the cover strips 30 are spaced from each other as designated by 91 so as to provide abutment surfaces 92 on one of the ends of locking ears 90. Similarly, the locking ear 90 adjacent flange 34 of the cover strips 30 is spaced from flange 30 as indicated by the numeral 91 or **91*a* in FIG. 6. Locking ears 90 on cover strips 30 are arranged so that when the cover strips 30 are in fully closed position, that is, closing all of the medicine compartments in the associated row, stops 84 of locking strip 83 will be received in the spaces 91a formed between the end locking ear 90 and the flange 34 of cover strip 30. Thus, stops 84 will be engageable against abutment surfaces 92 of locking ears 90** to prevent movement of the locking strips to open the compartments, thus serving as a positive lock means.

Should it be desired to move any one of the cover strips 30, actuating member 85 is depressed to the right to move locking strip 83 to the right as viewed in the drawings and this will serve to move stops 84 to the right into apertures 19 and out of the path of the abutment surfaces 92 of locking ears 90 on cover strips 30. While maintaining the actuating member 85 depressed, any one of the cover strips 30 may then be removed. Actuating member 85 may then be released and the spring bias of the actuating member 85 and 87 will serve to urge locking strip 83 to the left at which time stops 84 will engage along ear 90 until they are received in the next space 91 between the locking ears of the cover members 30 at which time the cover strips will again become locked against opening movement.

In the preferred embodiment, each of the locking ears 90 is provided with an inclined surface 93 leading to the space 91 formed between adjacent locking ears 90 as best shown in FIG. 6. Inclined surfaces 93 serve as cam surfaces which will permit the cover strips 30 to be slid back into the case to close the medicine compartments even though the actuating member 85 is released. This is achieved by the surfaces 93 functioning to cam stop 84 on locking strips 83 to move the stops 84 to the right out of the path of the cover strips 30.

It will thus be seen that the present invention uniquely incorporates a lock mechanism for positively locking the cover strips 30 in position and yet, at the same time, permitting the cover strips to be released by mere finger pressure on the locking strip to allow the cover strips to be moved to open the medicine compartments. It will also be seen that the lock mechanism does not detract from the appearance of the dispenser or its functioning in providing programmed storage and delivery of medicines. In addition, the lock mechanism is such as not to be easily operable by children or infants because even if the actuating member 85 is depressed, it is still necessary to grasp the cover strips and move them to open position. This sequence will not become apparent to children without instruction. Moreover, accidental depression of actuating member 85 by infants or children will have no effects as noted above.

What is claimed is:

1. In a medicine dispenser including a case having means defining a number of medicine compartments, and at least one cover slidable in the case over the compartments between a closed position closing the compartments and an open position opening the compartments for access through the top of the case; the improvement comprising lock means for locking said cover against movement between said positions thereof, said lock means including at least a stop thereon mounted for movement in the case between a first position in the path of movement of the cover for engaging a selected one of a plurality of abutment surfaces of the cover and blocking the cover against movement and a second position out of the path of the cover for permitting movement of the cover, said lock means further including a manually operable actuating member mounted to the case for movement relative to the case and being connected to the stop for actuating the stop between said positions thereof upon movement of the actuating member relative to the case.

2. The improvement defined in claim 1 wherein said manually operable actuating member includes a resilient member for biasing the stop into locking position preventing movement of the cover.

3. The improvement defined in claim 1 wherein said manually operable actuating member has one end fixed to the case and an opposite end spaced from the case and being connected to the stop to move the same, said actuating member being formed from resilient material such that when released it will bias the stop to said first position thereof.

4. The improvement defined in claim 1 wherein said cover has said abutment surfaces projecting therefrom to be engageable with said stop to prevent movement of the cover when the stop is in said first position thereof.

5. The improvement defined in claim 4 wherein the cover has the plurality of abutment surfaces spaced along the length thereof to define recesses for receiving the stop to prevent movement of the cover upon engagement with one of the abutment surfaces.

6. The improvement defined in claim 5 wherein said abutment surfaces are spaced along an edge portion of the cover.

7. The improvement defined in claim 5 wherein said cover has a plurality of locking ears spaced along the length thereof with the abutment surfaces formed on one of the ends of the locking ears and wherein the opposite ends of the locking ears are inclined to provide cam surfaces for engaging and moving the stop out of the path of the cover upon movement of the cover towards closed position closing the compartments.

8. The improvement defined in claim 1 incorporated in a medicine dispenser including a plurality of rows of medicine compartments and a plurality of associated covers movable between positions closing and opening the medicine compartments respectively and wherein said lock means includes a plurality of stops associated with each of the covers.

9. The improvement defined in claim 8 wherein said lock means includes an elongated locking strip mounted for slidable movement in the case and wherein said stops are fixed to the locking strip at locations spaced along the length of the locking strip and wherein said manually operable actuating member is fixed to the locking strip and is positioned externally of the case to be manually operable for moving the locking strip to move the stops into and out of locking positions relative to the associated cover.

10. The improvement defined in claim 9 wherein said actuating member has one end fixed to the case and an opposite end being fixed to the locking strip and being movable relative to the case to move the locking strip.

11. The improvement defined in claim 10 incorporated in a case having a top including a plurality of ribs spaced laterally from each other defining the plurality of rows of medicine compartments and wherein said locking strip extends transversely through apertures in the ends of said ribs.

* * * * *